United States Patent [19]

Kaiser

[11] 4,305,435

[45] Dec. 15, 1981

[54] WINDING AND CUTTING DEVICE

[75] Inventor: Juergen Kaiser, Regensburg, Fed. Rep. of Germany

[73] Assignee: Siemens Aktiengesellschaft, Berlin & Munich, Fed. Rep. of Germany

[21] Appl. No.: 98,644

[22] Filed: Nov. 29, 1979

[30] Foreign Application Priority Data

Dec. 29, 1978 [DE] Fed. Rep. of Germany ..... 2856739

[51] Int. Cl.[3] ..... B21F 15/04

[52] U.S. Cl. ..... 140/122; 242/7.17

[58] Field of Search ..... 339/276 A; 140/119, 140/122, 124; 242/7.17

[56] References Cited

U.S. PATENT DOCUMENTS 3,250,302 5/1966 Zoltai ..... 140/124 X

FOREIGN PATENT DOCUMENTS 1173465 12/1969 United Kingdom ..... 339/276 A

*Primary Examiner*—Eugene F. Desmond

*Attorney, Agent, or Firm*—Hill, Van Santen, Steadman, Chiara & Simpson

[57] ABSTRACT

A winding and cutting device for winding a wire on a connection pin of electrical components, and for the purpose of cutting off the excess remaining wire in one work cycle. A stationary sleeve is provided with a rotatable mandrel which has a central bore which is open at least in the direction of its one front face into which the pin is inserted during winding and which has, at least in the winding area, a diameter corresponding at least to the winding diameter. The sleeve and the mandrel have a slanted slot which is open at least in the direction of the one front face and which is aligned relative to the bore.

5 Claims, 6 Drawing Figures

WINDING AND CUTTING DEVICE

BACKGROUND OF THE INVENTION

The present invention relates to a winding and cutting device for the purpose of winding a wire on a pin; in particular, a connection pin for electric coils, and for the purpose of severing the excess remaining wire.

Until now it has been conventional to wind the wires on the connection pins of electric coils and the like manually and with the aid of tweezers or pincers. The excess pieces of remaining wire are severed off by means of diagonal-nosed cutting pliers. These devices are costly.

SUMMARY OF THE INVENTION

An object of the present invention is to provide a device which, in a simple fashion, will wind a wire on a pin and sever off the excess remaining wire, all in a single work cycle. Moreover, the device should be capable of use with connection pins of less than 10 mm, such as, for example, with coil formers or bobbins. In addition a small space requirement is important so that a plurality of devices can be combined.

In order to solve this problem the invention provides a stationary sleeve within which a mandrel is rotatably arranged so that the mandrel exhibits a central bore which is open at least toward its one front face and into which the pin enters during winding. At least in the winding area it preferably has a diameter corresponding at least to the winding diameter. The shell and the mandrel exhibit a slanting slot which is open at least in the direction of the one front face and is preferably tangentially aligned relative to the bore.

Preferably the mandrel is coupled with a drive, for example, a geared-electric motor, whose control is selected such that the slanted slots of the sleeve and of the mandrel are in alignment in the start or initial position of the device. The device, whose drive can be capable of actuation by means of a foot switch, is capable of being mounted e.g. on a workbench in such a fashion that the latter points in the direction of the connection pin.

DESCRIPTION OF THE PREFERRED EMBODIMENTS

Figure 1:
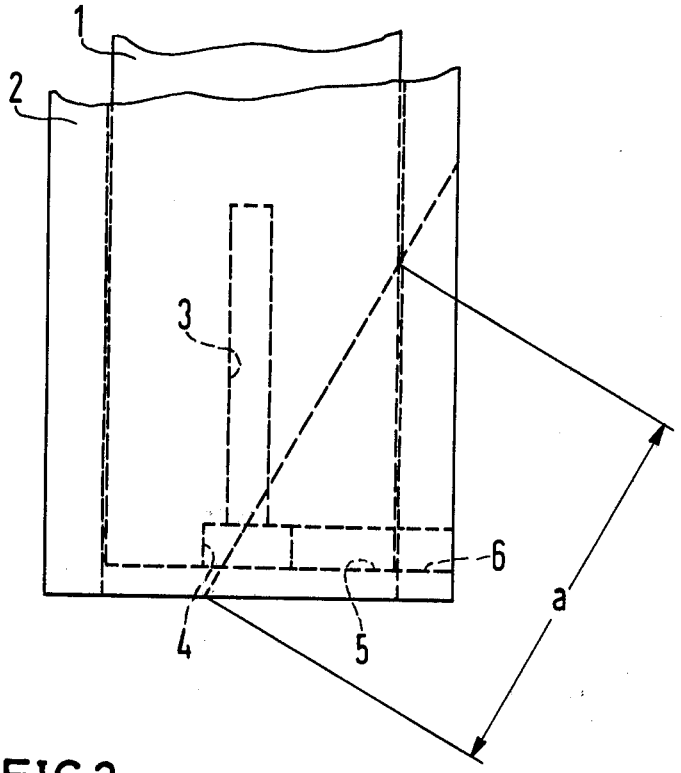
FIG. 1 illustrates, in a partial fragmented and broken-line illustration, a lateral view of the winding and cutting device according to the invention.

According to FIG. 1, the winding and cutting device has a stationary sleeve 2. Within this sleeve a mandrel 1 is rotatably mounted. The mandrel 1 has a central bore 3 which, as is indicated by 4, is enlarged or widened at the mandrel front end. The length and the inside diameters of the bore and of the enlargement 4 are determined by the maximum connection pin length, the diameter of the connection pin, and the diameter of the connection pin with wire; i.e., the so-called winding diameter. The depth of the enlarged part 4 of the bore 3 depends upon the desired winding length.

The mandrel 1 and the sleeve 2 each have one slanted slot 5 or 6, respectively, which are open in the direction of their one front face and are aligned relative to the bore with recess 4.

The method of operation of this device is as follows.

Figure 3:
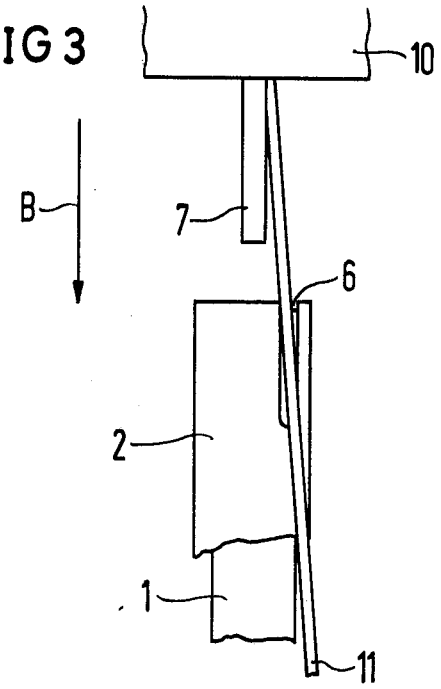
FIGS. 3 through 6 shows the method of operation of the device on the basis of various operating positions.
Figure 4:
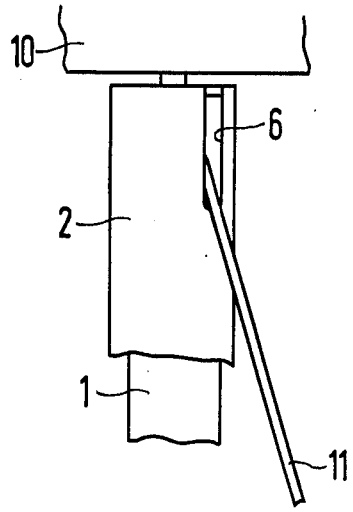
Figure 6:
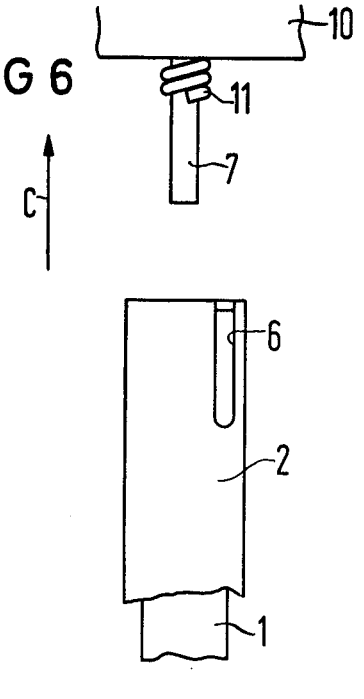
Figure 5:
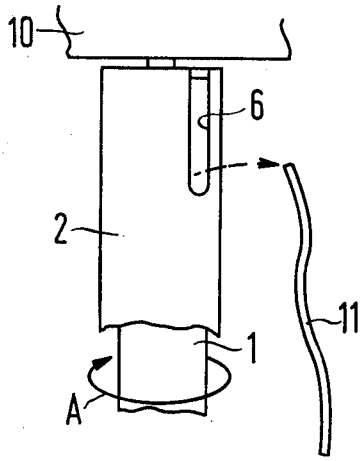

Through a correspondingly controlled drive, first the mandrel 1 and the sleeve 2 are transported into a relative position in which the two slanted slots 5 and 6 are in alignment. Subsequently, according to FIGS. 3 and 4, a wire 11 is inserted in the slanted slots and, e.g. a coil form 10 with connection pin 7, is transported in arrow direction B such that the connection pin is inserted in the bore 3. (See FIG. 4).

Figure 2:
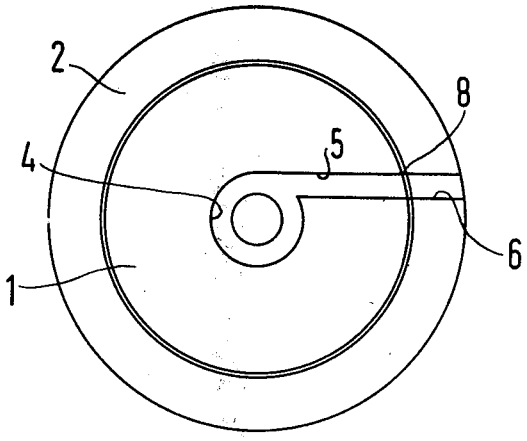
FIG. 2 shows a plan view of the device according to FIG. 1.

The sleeve 2 is held in fixed position and, through actuation of a foot switch, for example, the mandrel 1 is moved in arrow direction A via a drive not illustrated in the drawing such as a geared electric motor. In this fashion, with commencement of the rotational movement, the excess wire end is sheared off at the cutting edge shown in FIG. 2, and the wire length remaining in the mandrel winds itself completely about the connection pin 7 during further rotation of the mandrel. The length "a" (see FIG. 1) here determines the wire length remaining after the shearing-off in the mandrel and hence also the number of turns of the wire about the connection pin.

Subsequent to the pre-programmed number of mandrel rotations the mandrel is stopped in the initial position so that the slanted slots 5, 6 are again in a position of relative alignment. Finally the coil former 10 with the wound connection pin is removed from the device in arrow direction C.

Given correct dimensioning of the device, the wire is tightly fitted or seated to the connection pin, the windings are close together, and no externally protruding wire end is present.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A winding and cutting device, comprising: means for winding a wire on a connection pin and for severing excess remaining wire prior to winding the wire, all in one work cycle; said means including a stationary sleeve having a mandrel means rotatably arranged therein for winding the wire therein; a central bore in the mandrel means having an open end at least in a direction of a front face of the cutting device into which the connection pin is inserted during winding, the bore having at least in a winding region a diameter corresponding at least to a diameter of the winding; and the sleeve and the mandrel means each having a slanted slot which are open at least in a direction of said front face and which form a channel from the bore to a side of the sleeve for the wire when the two slots are aligned.

2. A winding and cutting device according to claim 1 wherein the channel formed by the slanted slots intersects the bore tangentially.

3. A winding and cutting device according to claim 1 wherein in a start position the slanted slots of the mandrel means and of the sleeve are in alignment and extend only to one side of the sleeve.

4. A winding and cutting device, comprising: means for winding a wire on a connection pin and for severing excess remaining wire prior to winding the wire; said means including a stationary sleeve having a mandrel means rotatably arranged therein for winding the wire;

a central bore in the mandrel means having an open end at a front connection pin insertion face of the cutting device, the bore having a length sufficient to accommodate the connection pin and an enlarged winding region at the front face having a diameter which is greater than adjacent portions of the bore and which is sufficient to accommodate the wound wire on the connection pin; and the sleeve and the mandrel means each having a slot which forms a channel for the wire from the central bore to a side of the stationary sleeve.

5. The device of claim 4 wherein cutting means are provided at an interface between the mandrel means and sleeve at the slots and wherein the slots are slanted.

* * * * *